US006895636B2

(12) United States Patent
Nussbaum

(10) Patent No.: US 6,895,636 B2
(45) Date of Patent: May 24, 2005

(54) ADJUSTABLE HINGE-FRAME ARRANGEMENT

(75) Inventor: Bjoern Nussbaum, Osnabrueck (DE)

(73) Assignee: Solarlux Aluminium Systeme GmbH, Bissendorf (DE)

( * ) Notice: Subject to any disclaimer, the term of this patent is extended or adjusted under 35 U.S.C. 154(b) by 371 days.

(21) Appl. No.: 09/845,975

(22) Filed: Apr. 30, 2001

(65) Prior Publication Data

US 2003/0024072 A1 Feb. 6, 2003

(30) Foreign Application Priority Data

May 2, 2000 (DE) ..... 100 21 330

(51) Int. Cl.[7] ..... E05D 7/04
(52) U.S. Cl. ..... 16/241; 16/387; 16/382
(58) Field of Search ..... 16/241, 239, 235, 16/382, 271, 272, 387, 388, 389; 49/482.1, 44, 397, 399, 468; 160/206, 38

(56) References Cited

U.S. PATENT DOCUMENTS 3,774,345 A * 11/1973 Cole et al. ..... 49/504
4,825,507 A * 5/1989 Killingstad ..... 16/241
5,150,500 A * 9/1992 Bisbing ..... 16/239
5,339,493 A * 8/1994 MacIntyre ..... 16/238
5,515,901 A * 5/1996 Hall ..... 160/206
5,799,370 A * 9/1998 Davidian et al. ..... 16/236

FOREIGN PATENT DOCUMENTS

DE 2436289 2/1976
DE 3525717 2/1986

* cited by examiner

*Primary Examiner*—Suzanne Barrett
*Assistant Examiner*—Mark Willliams
(74) *Attorney, Agent, or Firm*—Jordan and Hamburg LLP

(57) ABSTRACT

An adjustable hinge-frame arrangement, especially for folding arrangements with a hinge (5) having two hinge leaves (6), which can be swiveled relative to one another over gudgeons (7) and a hinge pin (8), each hinge leaf (6) being connected with a frame (3) of a door or window element (2) or the like, is constructed pursuant to the invention so that each hinge leaf (6) has an integral molding (9), with which it engages a corresponding recess (10) of the side surface (11) of the respective frame (3), which recess is formed with clearance in such a manner with respect to the integral molding (9), that the side surface (11) of the frame (3) and the hinge leaf (6) can be tilted with respect to one another and the hinge leaf (6) has locking means, with which the different angular positions between the side surface (11) of the frame (3) and the hinge leaf (6) can be fixed detachably. Preferably, the recess (10) of the side surface (11) of the frame (3) has undercuts (18), by means of which the integral molding (9) is held in the form of a rocker.

25 Claims, 6 Drawing Sheets

ADJUSTABLE HINGE-FRAME ARRANGEMENT

BACKGROUND OF THE INVENTION

Figure 1:
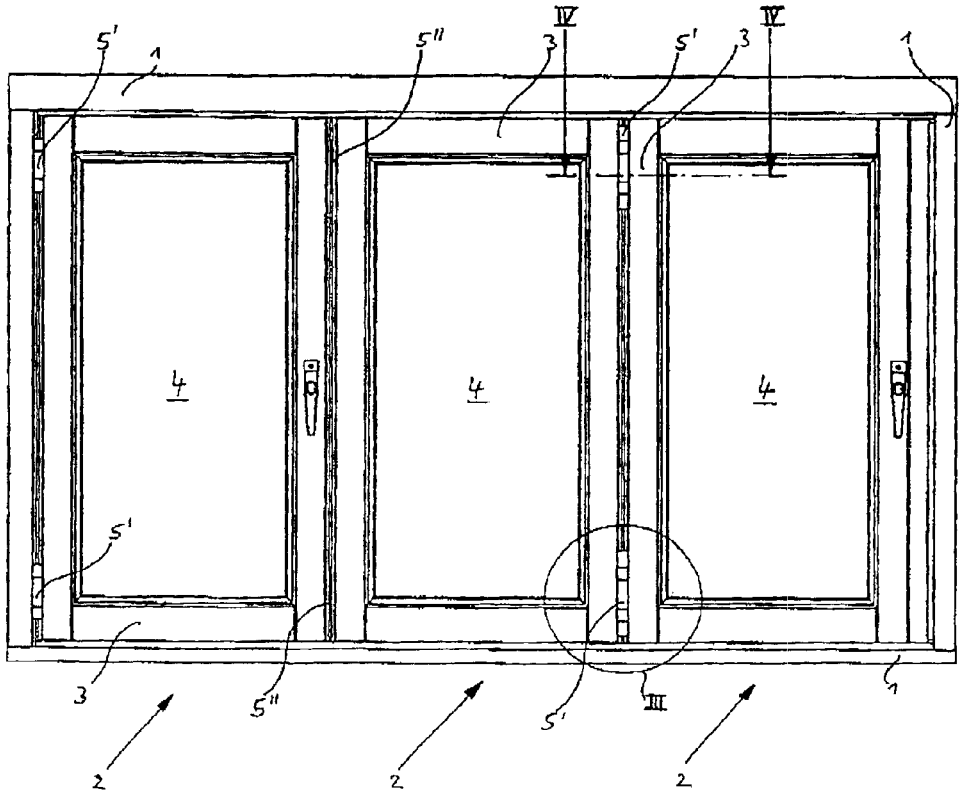

The invention relates to a hinge-frame arrangement which is constructed adjustably to compensate for possible inaccurate distance dimensions between the frame of a window or door element or a similar pivotable leaf and an adjacent leaf or an exterior frame.

Hinges, designed for such arrangements, are used particularly for folding arrangements, multiple-part veranda doors or similar multi-part pivotable structural elements, which are to be opened. In the case of folding arrangements, several leaf elements, such as windows or doors, are joined together with hinges. In the simplest case, the one outer leaf at one side of the outer frame, fastened to the building, is connected with hinges with the building and closes off the other outer leaf to the outer frame over seals. The individual leaves can be folded together with movable supports from the closed position to one side in the direction of the leaf, which is connected with the outer frame, to form a leaf package. Such folding arrangements are always manufactured to meet the special requirements and dimensions of the opening in the building. For this purpose, a width is calculated for each leaf and frequently cannot be expressed in whole millimeters. However, the corresponding blanks of profiles or wood cannot be realized practically in fractions of millimeters, so that the dimension, calculated for each leaf, is rounded off to whole millimeters. If these leaves are combined with hinges to form a chain, there may be a gap between the outer leaf and the outer frame, which can no longer be closed off with conventional seals. Therefore, for such structural members, hinge-frame arrangements are used in practice which, for each hinge, make a slight adjustment possible in the distance between the two leaves connected by the hinge, so that the total difference can be compensated for over the whole width of the folding arrangement.

In the case of hinges, which are conventionally used in such arrangements and consist of two hinge leaves connected with a hinge pin, at least one of the two hinge leaves is constructed in several parts, the multi-part hinge leaf having a plate, which can be screwed tightly to the frame of the door or window leaf and is connected at an adjustable distance with the other element of the multi-part hinge leaf. As a result, the distance between the two window or door leaves can be changed. In the case of a different hinge, known from practical experience, the hinge gudgeons are provided with an eccentric bushing, which is inserted in gudgeon and which can be fixed rotatably in different positions. The distance between the hinge leaves in the closed position can then also be changed by rotating the eccentric bushing. Because they consist of many parts, these hinges are expensive to manufacture and to install at the frame of the door or window element and it is cumbersome to adjust them. Moreover, hinges with multi-part hinge leaves frequently are mechanically unstable and less suitable for heavy door or window elements.

SUMMARY OF THE INVENTION

It is an object of the invention to provide an adjustable hinge-frame arrangement, which is structurally simple, inexpensive to construct and easy to install and adjust and which provides a stable connection for door and window elements or the like.

By providing integral moldings at the hinge leaves and corresponding recesses formed opposite the integral moldings with clearance in the side surfaces of the frames, hinge leaves and frames can be tilted relative to one another, as a result of which different gaps can be obtained in the hinge by fixing the respective angular position. Since the hinge leaves are not constructed in several parts, the arrangement is stable and the manufacture of the hinge simplified. Both hinge leaves can be produced, in particular, from the identical profile, merely by incorporating recesses for the gudgeon or gudgeons of the respective other hinge leaf, for example, by milling, in the rear region accommodating the hinge pin.

Further advantages and details arise out of the dependent claims and are given in the examples of the invention, which are explained in the following and shown in the accompanying drawings.

IN THE DRAWINGS

Figure 2:
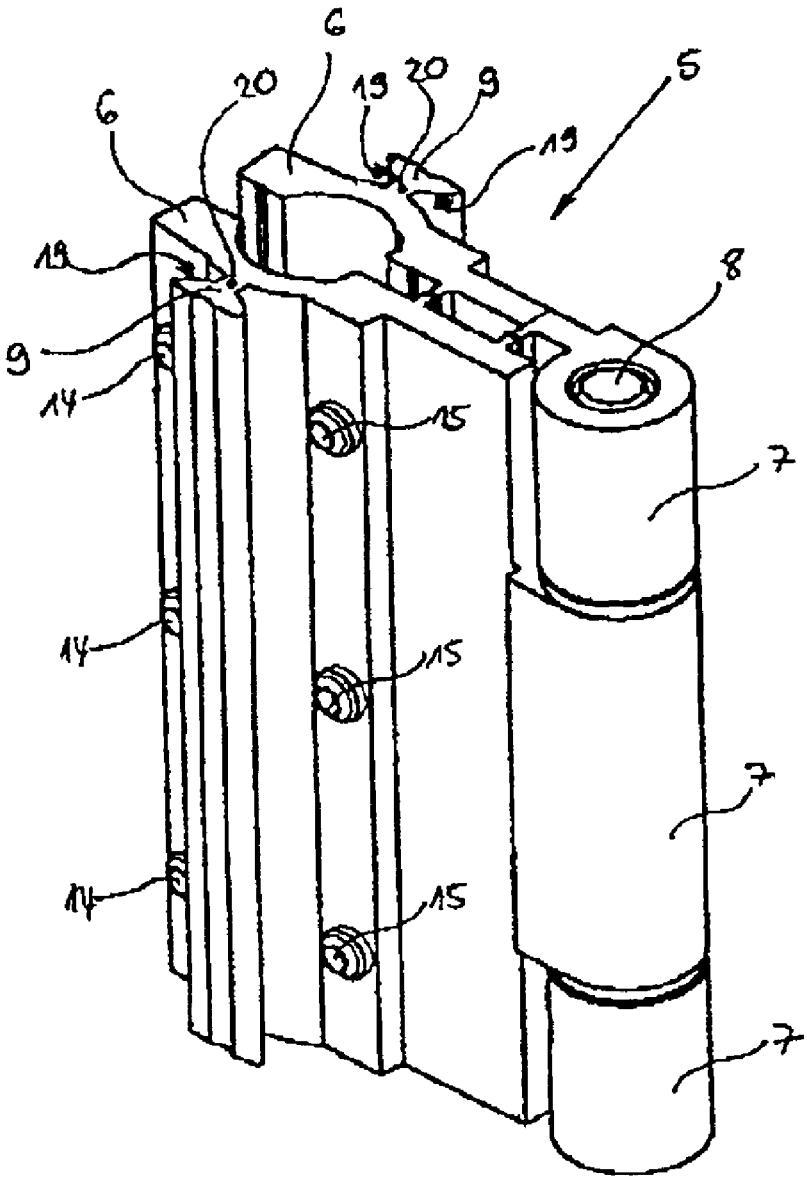
Figure 3:
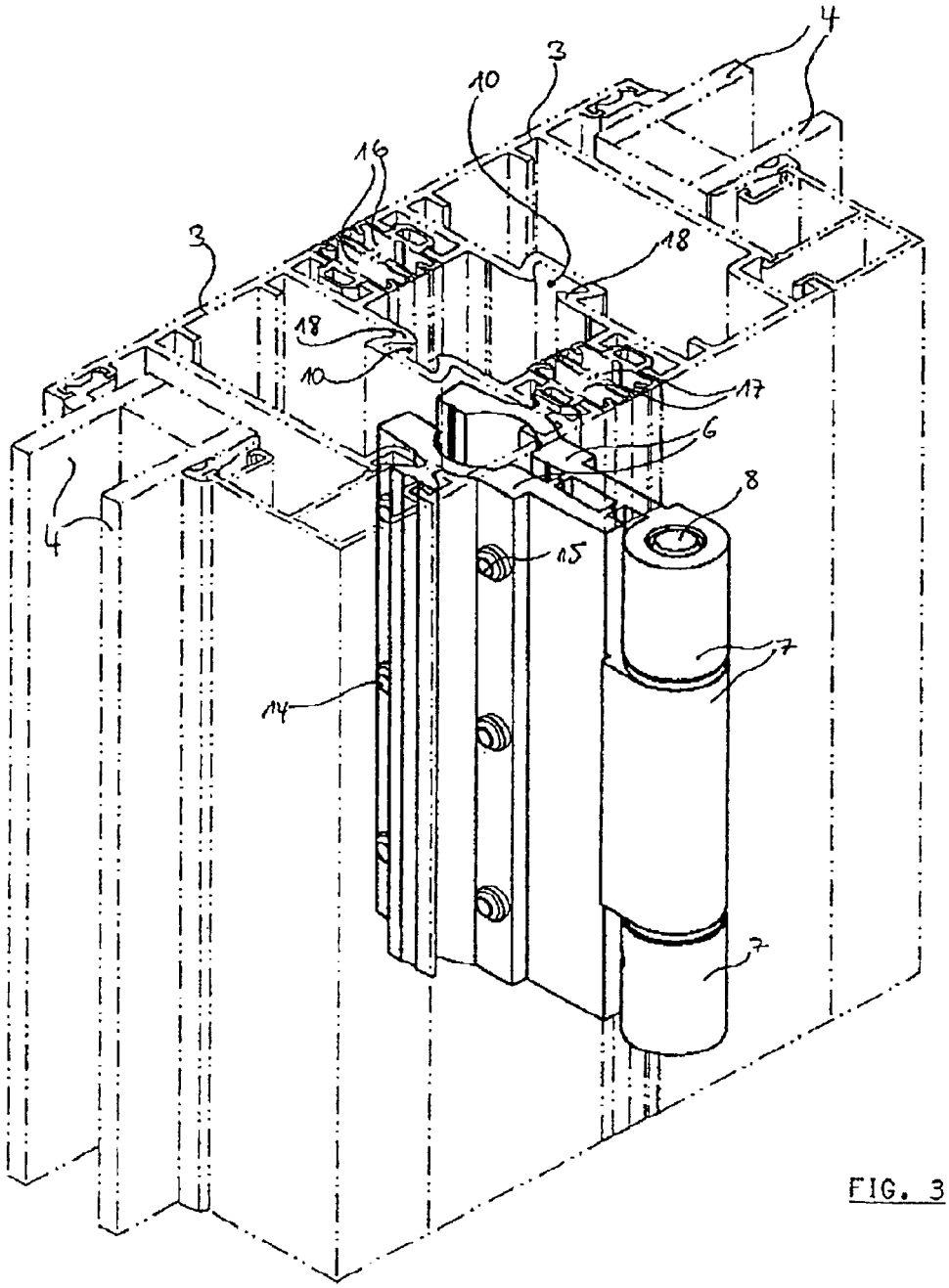
Figure 4:
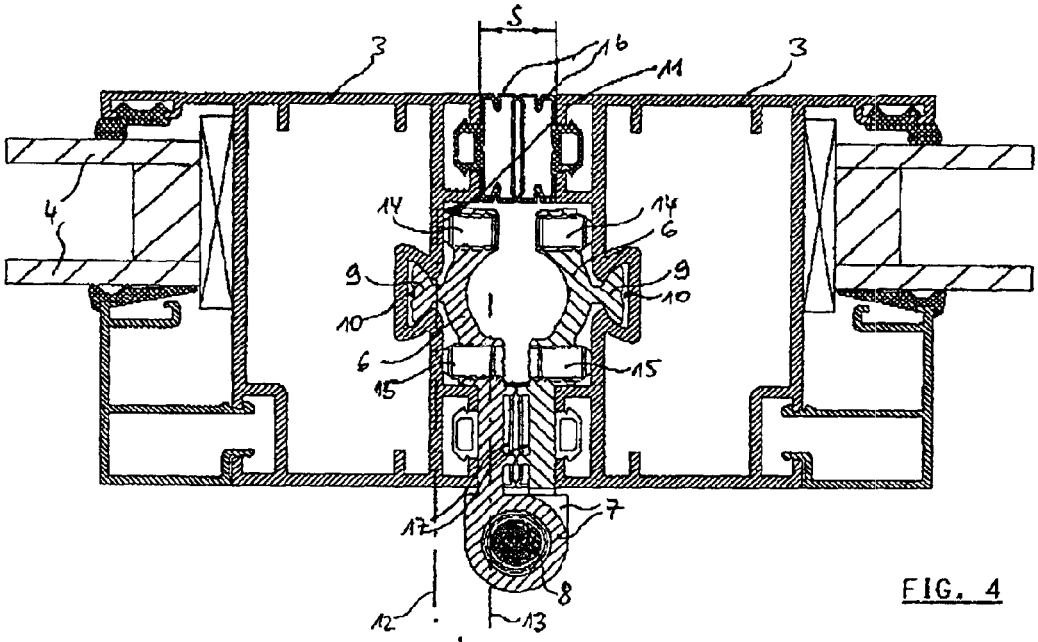
Figure 5:
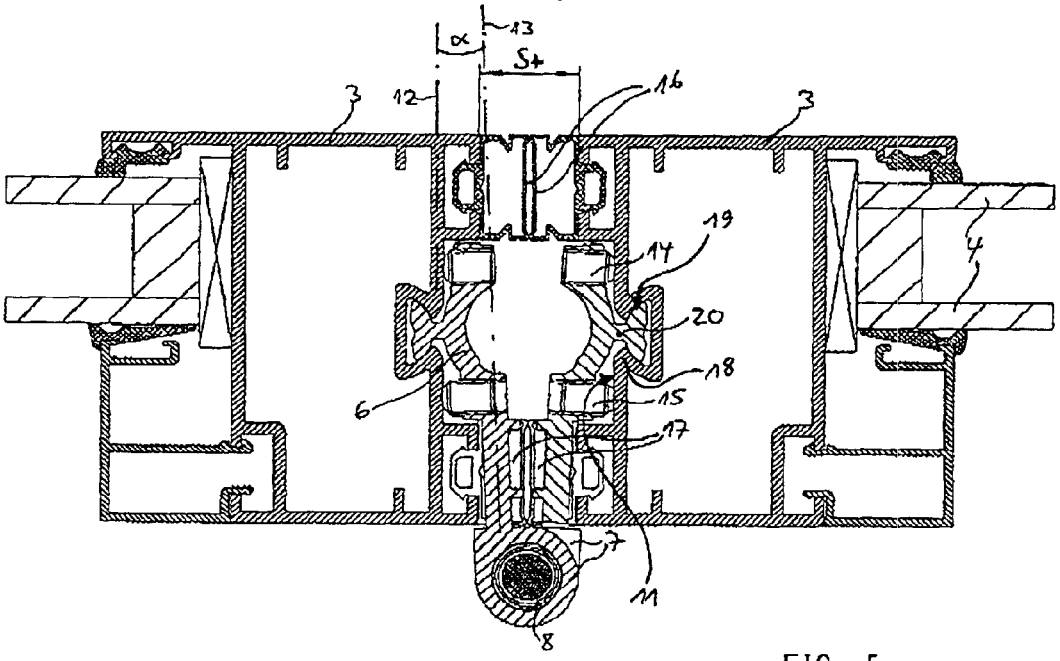
Figure 6:
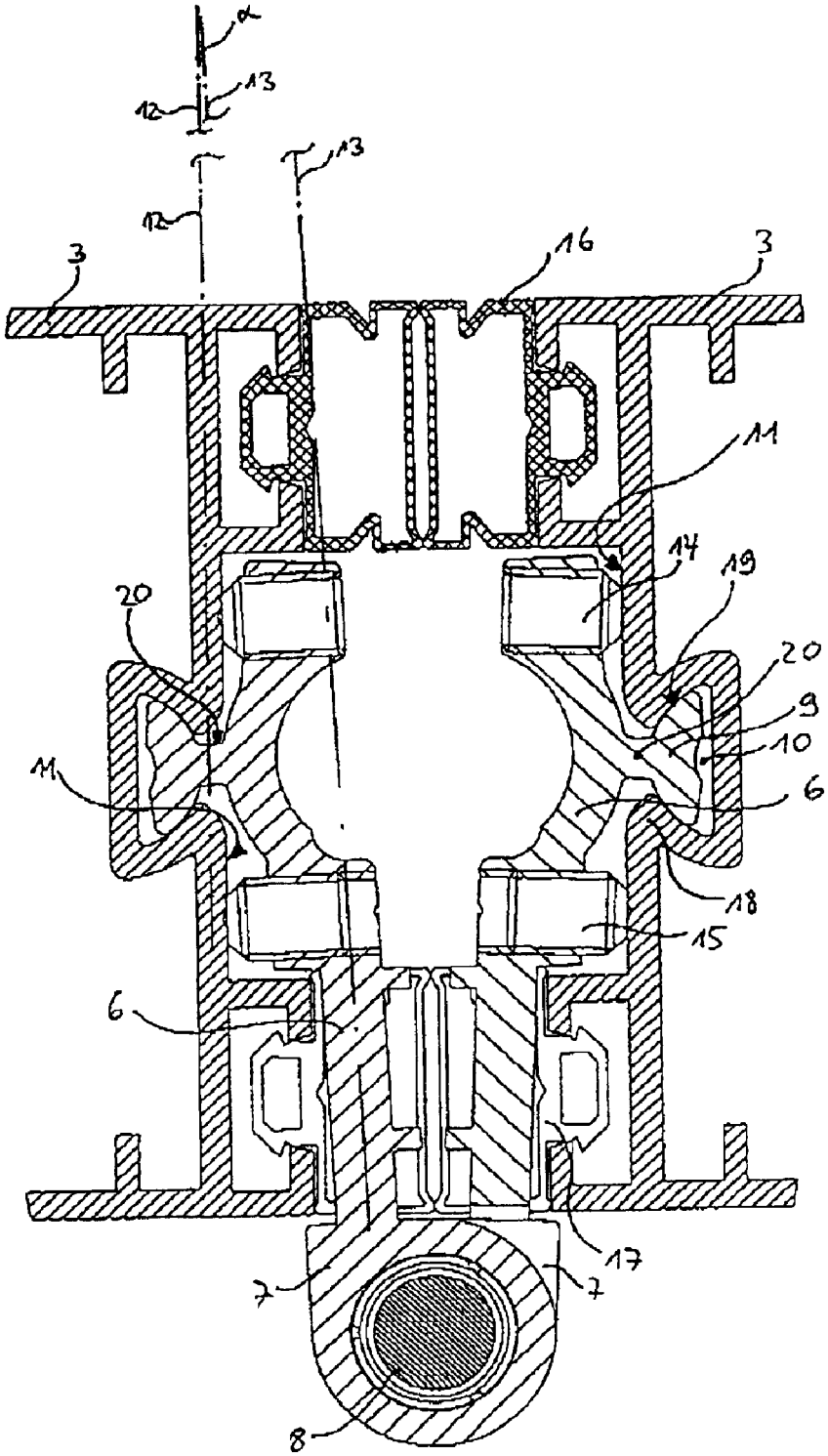
Figure 7:
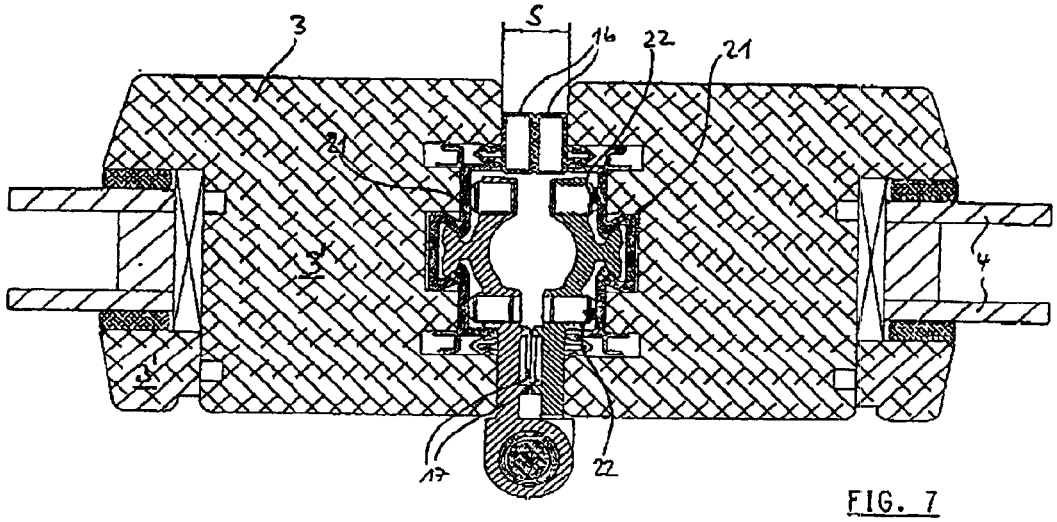
Figure 8:
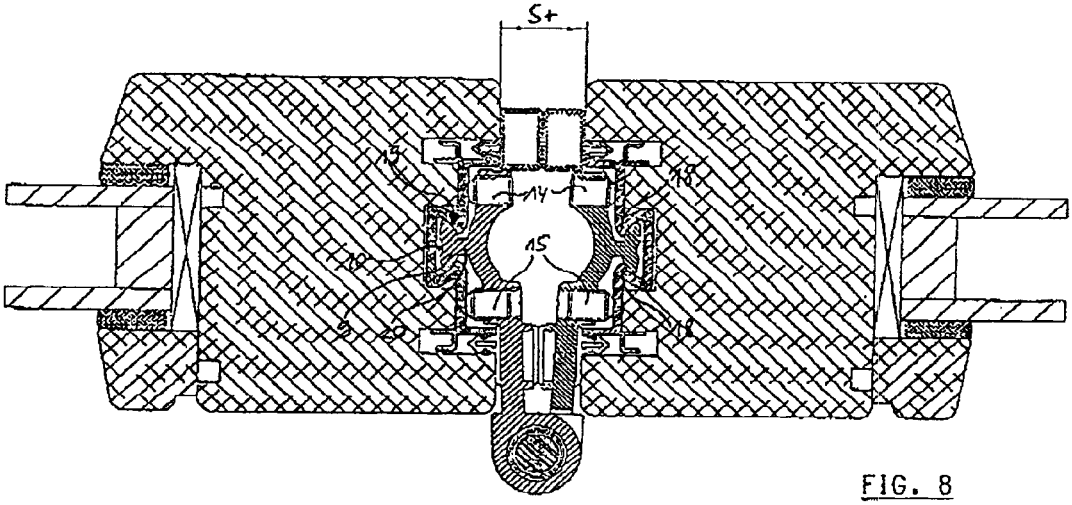

FIG. 1 shows an inner view of a folding arrangement with inventive hinge-frame arrangements, FIG. 2 shows a perspective view of one of the hinges used in the arrangement, FIG. 3 shows a detail on a larger scale of the section III in FIG. 1 in a perspective view, FIG. 4 shows a section along the line IV—IV in FIG. 1, FIG. 5 shows the object of FIG. 4 in a different angular position, FIG. 6 shows an enlarged representation of the hinge-frame arrangement of FIG. 5, FIG. 7 shows a different embodiment of the object of FIG. 4, and FIG. 8 shows the object of FIG. 7 in a different angular position corresponding to FIG. 5.

DESCRIPTION OF THE PREFERRED EMBODIMENTS

FIG. 1 shows a folding arrangement with three window elements 2 held in an outer frame 1. The window elements 2 in each case have a frame 3, in which the glass panes 4 are inserted. The frames 3 are connected with one another by hinges 5, which are disposed alternately on the inside (5') and the outside (5"). The outer left window element 2 is also fixed over hinges 5 to the outer frame 1. FIG. 2 shows such a hinge 5 and, in FIG. 3, the hinge 5 is shown in the installed state, the frame 3 being drawn transparently with lines of dots and dashes.

In particular, in FIGS. 4 to 7, the inventive construction of the hinge 5 can be recognized. It has integral moldings 9 at its hinge leaves 6, which are pivotably fixed to one another over gudgeons 7 and a hinge pin 8. These integral moldings 9 engage corresponding recesses 10 in the frame 3, which have sufficient clearance from the integral moldings 9, so that the angle between the hinge leaf 6 and the side surface 11 can be adjusted by tilting like a rocker. In the arrangement, shown in FIG. 4, the plane 12 of the side surface 11 of the frame 3 and the longitudinal frame 13 of the hinge leaf 6 are parallel. On the other hand, in FIG. 5, an angular position is selected, in which the two frames 12, 13 enclose an angle $\alpha$, as a result of which the distance between the two frames 3, in comparison to the position shown in FIG. 4, was enlarged when the folding arrangement is closed. For this purpose, the position of the locking means, formed by set screws 14, 15, with respect to the hinge leaf 6, was changed. Compared to FIG. 4, the inner set screws 14 were turned so as to pull them further into the hinge leaves 6, whereas the outer set screws 15 were unscrewed further out of the hinge leaves 6.

The remaining gap SS+ between the frames 3 is closed off draft-tight by the pinched seals 16, 17, which are let into the frame 3. The set screws 14, 15 are disposed on either side of the integral molding 9; this provides a special stability to the fastening of the hinge 5 and to the angular position selected. The set screws 14, 15 represent a simple possibility for fixing and fastening. The recesses 10 of the side surfaces 11 of the frame 3 have undercuts 18, which partially embrace the integral moldings 9, so that the set screws 14, 15, for fixing, do not have to be screwed into the frame 3. Instead, they are only supported at the side surface 11 of frame 3 and hold the hinge leaf 6 wedged with this side surface 11. In addition to the adjusting function, the set screws 14, 15, at the same time, assume the fastening function for the whole hinge 5 at the frame 3 and, especially when the recess 10 of the side surface 11 of the frame 3 is advantageously manufactured as a continuous groove, prevent the hinge 5 slipping to the side in the vertical along the frame 3.

For the preferred embodiment, the integral moldings 9, on either side, have convex guiding surfaces 19, which optimally slide circularly in the recesses 10 of the side surfaces 11 of the frame 3 when the hinge 5 is adjusted. Due to this shape, the tilting motion, when the angle between the hinge leaf 6 and the side surface 11 of the frame 3 is adjusted, follows a defined contour, which facilitates a rapid and precise adjustment. The guiding surfaces 19 are distanced from the hinge leaf 6 over a cross member 20, so that the undercuts 18 can embrace the guiding surfaces 19 and so that the distance is sufficient to accommodate an adjustment movement.

In the embodiment of FIGS. 2 to 6, the frame 3 is made from an aluminum profile. On the other hand, the frames 3 in the embodiments of FIGS. 7 and 8 consist essentially of wood 3'. To simplify the manufacture of the recesses 10 and to avoid that the set screws 14, 15 press into the wood, a preferably metallic profile rail 21 is let into the frame 3 and forms the recesses 10 and the supports 22 for the set screws 14, 15.

The inventive hinge-frame arrangement can be used not only to compensate for a dimensional difference between the total width of the window elements 2 of a folding arrangement and the corresponding outer frame 1, but is also suitable for compensating for possible settling phenomena. If, for example, an outer window element 2 of the folding arrangement, which is hinged only at one side, has been shifted in such a manner that the lock side rests and drags on the ground, the settling of the window elements 2 on the ground can be counteracted by using at least two adjustable hinges 5 per frame side, in that the gap dimension of the lower hinge 5 is enlarged and/or the gap dimension of the upper hinge 5 is decreased.

The hinges 5 can be adjusted at any time without dismantling the window elements 2. When the hinges 5 are shifted or adjusted, a complete loosening or slippage to one side of the hinge 5 is avoided, owing to the fact that the set screws 14, 15 are loosened in each case only at one side surface 11 of the frame 3, while the height and position of the hinge 5 remains ensured because the other hinge leaf 6 is fixed to the other side surface 11 of the other frame 3. Since adjacent window elements 2 generally are connected with at least two hinges 5, the connection of the window elements 2 with one another also always remains secure.

What I claimed is:

1. A hinged frame arrangement, comprising:

first and second frame members;

a hinge having first and second leaves respectively having outer surfaces mounted to said first and second frame members, said first and second leaves being pivotally connected to one another about a pivot axis to permit relative rotatable mounting of said first and second frame members;

at least said first frame member having a side surface having a recess extending longitudinally and defining a recess opening and a recess width increasing with depth of said recess into said first frame member;

at least said first leaf having a recess engaging member formed as one continuous piece with said leaf, said recess engaging member extending from said outer surface and captively received in said recess by virtue of said recess engaging member having a width which increases with depth in said recess such that said recess engaging member has a width which is greater than a width of said recess opening, said width of said recess opening being sufficiently wide to permit pivoting of said recess engaging member in said recess thereby permitting an angle defined by said outer surface and said side surface to be varied; and locking means for locking maid first leaf relative to said side surface to adjustably set said angle defined by said outer surface and said side surface to be varied.

2. The hinged frame arrangement of claim 1, wherein said recess is an elongate groove extending along said side surface.

3. The hinged frame arrangement of claim 1, wherein said recess defines undercuts adjacent said recess opening.

4. The hinged frame arrangement of claim 1, wherein said locking means extend from said outer surface of said at least first hinge leaf to displace said outer surface from said frame member against retention force of said recess engaging member engaged in said recess.

5. The hinged frame arrangement of claim 4, wherein said recess engaging member is arranged in an intermediate region of said outer surface and said locking means are disposed on both sides of said recess engaging member.

6. The hinged frame arrangement of claim 5, wherein said locking means comprise set screws.

7. The hinge-frame arrangement of claim 1, wherein said recess engaging member includes guiding surfaces for pivotally engaging inner surfaces of said recess, said guiding surfaces including an arch contoured portion facing said outer surface of said at least first hinge leaf and pivotally engaging said inner surfaces of said recess.

8. The hinged frame arrangement of claim 7, wherein said recess engaging member includes a cross member interposed between said guiding surfaces and said outer surface of said at least first hinge leaf.

9. The hinged frame arrangement of claim 1, wherein said frame member includes a rail defining said recess.

10. The hinged frame arrangement of claim 9, wherein said rail is made of a metallic material.

11. The hinged frame arrangement of claim 1, wherein said frame member includes a rail defining supports against which said locking means bear.

12. The hinged frame arrangement of claim 1, further comprising seals arranged between said first and second frame members for sealing a space between said first and second frame members.

13. The hinged frame arrangement of claim 1, wherein said locking means are screws extending from said outer surface of said at least first hinge leaf to displace said outer surface from said frame member against retention force of said recess engaging member engaged in said recess.

14. The hinge-frame arrangement of claim 13, wherein said recess engaging member includes guiding surfaces for pivotally engaging inner surfaces of said recess, said guiding surfaces including an arch contoured portion facing said outer surface of said at least first hinge leaf and pivotally engaging said inner surfaces of said recess.

15. The hinge-frame arrangement of claim 14, wherein said inner surfaces of said recess are arch contoured and pivotally engage said arch contoured portion of said recess engaging member.

16. The hinge-frame arrangement of claim 1, wherein said recess engaging member includes guiding surfaces for pivotally engaging inner surfaces of said recess, said guiding surfaces including an arch contoured portion facing said outer surface of said at least first hinge leaf and pivotally engaging said inner surfaces of said recess.

17. The hinge-frame arrangement of claim 16, wherein said inner surfaces of said recess are arch contoured and pivotally engage said arch contoured portion of said recess engaging member.

18. The hinge-frame arrangement of claim 17, wherein said recess is a slot.

19. The hinge-frame arrangement of claim 1, wherein said recess is a slot.

20. The hinge-frame arrangement of claim 3, wherein said recess is a slot.

21. The hinge-frame arrangement of claim 4, wherein said recess is a slot.

22. The hinge-frame arrangement of claim 5, wherein said recess is a slot.

23. The hinge-frame arrangement of claim 13, wherein said recess is a slot.

24. The hinge-frame arrangement of claim 14, wherein said recess is a slot.

25. The hinge-frame arrangement of claim 16, wherein said recess is a slot.

* * * * *